US007896099B2

(12) United States Patent
Saf

(10) Patent No.: US 7,896,099 B2
(45) Date of Patent: Mar. 1, 2011

(54) UPPER BEAM FOR A TELESCOPIC FEEDER, TELESCOPIC FEEDER AND DRILLING DEVICE FOR ROCK DRILLING

(75) Inventor: Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 424 days.

(21) Appl. No.: 12/086,872

(22) PCT Filed: Jan. 19, 2007

(86) PCT No.: PCT/SE2007/000049

§ 371 (c)(1),
(2), (4) Date: Jun. 20, 2008

(87) PCT Pub. No.: WO2007/091939

PCT Pub. Date: Aug. 16, 2007

(65) Prior Publication Data

US 2010/0218998 A1 Sep. 2, 2010

(30) Foreign Application Priority Data

Feb. 10, 2006 (SE) ..... 0600293

(51) Int. Cl.
*E21B 19/08* (2006.01)
*F16C 29/02* (2006.01)

(52) U.S. Cl. ..... 173/141; 173/4; 173/147; 173/152; 384/39; 384/41; 384/42; 175/203; 175/220

(58) Field of Classification Search ..... 173/4, 173/38, 141, 147, 152, 160, 195; 384/41, 384/42, 26, 29, 17, 39; 175/220, 421, 203, 175/323

See application file for complete search history.

(56) References Cited

U.S. PATENT DOCUMENTS

| | | | | | |
|---|---|---|---|---|---|
| 1,831,445 | A | * | 11/1931 | Hansen | 384/42 |
| 2,726,065 | A | * | 12/1955 | Feucht | 173/147 |
| 3,402,777 | A | * | 9/1968 | Watson | 173/147 |
| 3,650,576 | A | * | 3/1972 | Hughes | 384/41 |
| 3,994,350 | A | * | 11/1976 | Smith et al. | 175/85 |
| 4,250,973 | A | * | 2/1981 | Hall | 173/147 |

(Continued)

FOREIGN PATENT DOCUMENTS

WO 9518912 7/1995

(Continued)

*Primary Examiner*—Scott A. Smith
(74) *Attorney, Agent, or Firm*—Mark P. Stone

(57) ABSTRACT

The object of the invention is to provide a drilling device which is compact and has good sliding properties. The object is achieved by an upper beam for use with a lower beam in a telescopic feeder for a drilling device for rock drilling. The upper beam extends along a longitudinal axis and has a generally U-shaped cross section comprising a bottom wall and a first and a second side wall. Each side wall has an inward surface and an outward surface. The upper beam comprises a cooperating member intended for sliding cooperation with the lower beam. The cooperating member comprises an attachment structure extending outwardly from each outward surface of each side wall. Each attachment structure is intended for fixed mounting of a crank block bracket, which crank block bracket faces the outward surface of each side wall.

22 Claims, 3 Drawing Sheets

U.S. PATENT DOCUMENTS 4,566,738 A * 1/1986 Fasth ..... 384/29
4,925,320 A * 5/1990 Foster et al. ..... 384/42
5,599,107 A * 2/1997 Wireman ..... 384/57
5,704,716 A 1/1998 Jantunen
6,009,957 A * 1/2000 Esko et al. ..... 173/4
7,100,709 B2 * 9/2006 Bowe et al. ..... 175/113
7,371,009 B1 * 5/2008 Burgess et al. ..... 384/39

FOREIGN PATENT DOCUMENTS

WO 2004/074626 9/2004

* cited by examiner

UPPER BEAM FOR A TELESCOPIC FEEDER, TELESCOPIC FEEDER AND DRILLING DEVICE FOR ROCK DRILLING

TECHNICAL FIELD

The present invention relates to an upper beam intended to be used with a lower beam in a telescopic feeder for a drilling machine for rock drilling. The present invention also relates to a telescopic feeder for a drilling machine and a drilling device for rock drilling.

BACKGROUND OF THE INVENTION

In bolting in narrow drifts in mines, there is often a conflict between the desired advance per round for the blast hole drilling and the feeding length in bolt drilling. If the required length for the blasting was to be drilled, the feeder would be so long that it would not be possible for it to be arranged transversely in the drift. One way of solving this problem is to use a feeder with displaceable drilling supports or to use a telescopic feeder. A telescopic feeder has a lower beam and an upper beam which is slidably arranged on the lower beam. The length of the telescopic feeder may be changed so that it may be extended to the desired length in a drilling condition and retracted which results in that it may be accommodated transversely in the drift when needed. One problem with telescopic feeders is that they are heavy and ungainly.

An example of a telescopic feeder is disclosed in WO9518912. This telescopic feeder comprises a lower beam and an upper beam slidably mounted on the lower beam. The slide rail, intended for the sliding arrangement between the upper beam and the lower beam, is placed solely on the lower portion of the upper beam which makes the lower beam low. This results in a reduced height of the telescopic feeder. The disadvantage of this design is that the upper beam becomes heavy and ungainly. This is in particular a problem when the feeder is used in a position where it has been rotated somewhat around its axis. The leverage with a heavier upper beam and lighter lower beam will then result in impaired friction between the beams.

SUMMARY OF THE INVENTION

It is therefore an object of the present invention to provide a drilling device which is compact and has good sliding properties.

According to the present invention, this object is achieved by an upper beam intended to be used with a lower beam in a telescopic feeder for a drilling machine for rock drilling. The upper beam extends along a longitudinal axis and has a generally U-shaped cross section comprising a bottom wall and a first and a second side wall, wherein each side wall has an inward surface and an outward surface. The upper beam comprises a cooperating member intended for slidable cooperation with the lower beam. The cooperating member comprises an attachment means extending outwardly from each outward surface of each side wall. Each attachment means is intended for fixed mounting of a crank block bracket, which crank block bracket faces said outward surface of each side wall.

According to the present invention, this object is also achieved by a telescopic feeder for a drilling machine for rock drilling. The telescopic feeder comprises a generally U-shaped lower beam and the upper beam according to the present invention.

According to the present invention, this object is also achieved by a drilling device for rock drilling, comprising a drilling machine and a telescopic feeder according to the present invention.

Since the upper beam comprises crank block brackets facing the side wall of the upper beam, a space is created between the crank block bracket and the side walls of the upper beam, which space enables the upper beam to travel partly in the lower beam, which makes the telescopic feeder compact. Since the crank block brackets, having a much lower weight than the slide rail, are arranged at the upper beam, the weight of the upper beam is kept low which means a reduced leverage and thus improved sliding properties.

An advantage of the present invention is that it provides for an improved view for the person performing the drilling since the telescopic feeder is not very high, i.e. the telescopic feeder is more compact.

A further advantage of the present invention is that the lower beam, which is subjected to large forces, is strong and robust. This is since slide rails for sliding cooperation with the upper beam are arranged along the lower beam which makes it more heavy and stable.

DETAILED DESCRIPTION

A number of embodiments of the invention will now be described with reference to the drawings. The present invention is not limited to these embodiments. Various variants, equivalents and modifications may be used. Therefore, the embodiments should not be considered as limitations of the scope of the invention, which scope is defined by the appended claims.

Figure 1:
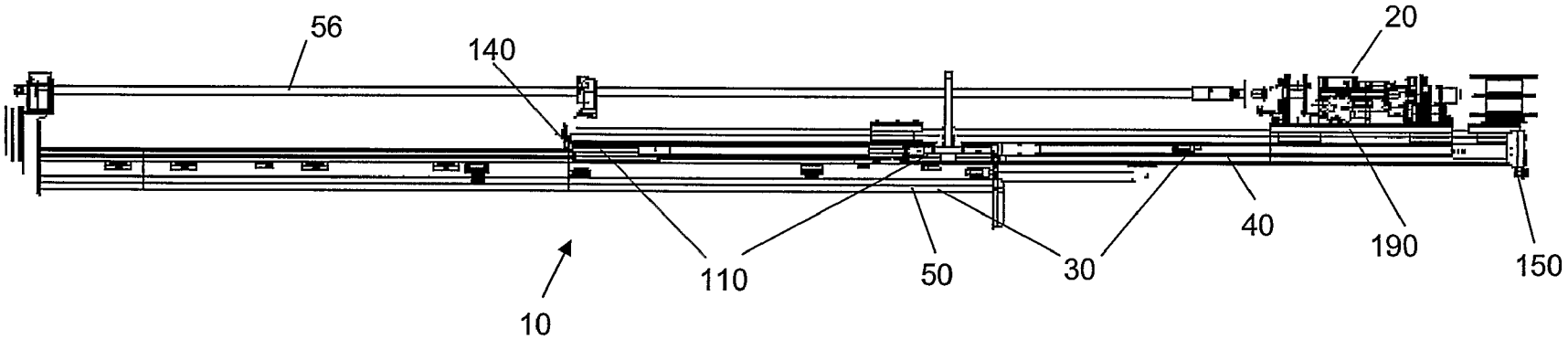
FIG. 1 is a schematic side view of a drilling device for rock drilling according to the present invention.

FIG. 1 discloses a drilling device 10 for rock drilling. The drilling device 10 comprises a drilling machine 20 and a telescopic feeder 30 which telescopic feeder 30 comprises a upper beam 40 and a lower beam 50. The upper beam 40 is slidably arranged on the lower beam 50 along the longitudinal axes of both beams 40, 50. The telescopic feeder 30 has an initial position wherein the upper beam 40 and the lower beam 50 are in a fully overlapping relation. The length of the telescopic feeder 30 may be changed so that it extends by displacing the upper beam 40 and the lower beam 50 so that they are less and less in an overlapping relation up to a maximum extended position. The drilling machine 20 is slidably arranged on the telescopic feeder 30 so that it is displaceable along the upper beam 40 of the telescopic feeder 30, this may be performed in a conventional manner, e.g. using a feeding cylinder mounted between the upper beam and the drilling machine by a cable. The drilling machine 20 is thus movable back and forth along the longitudinal axis of the upper beam 40. In FIG. 1, a boring tool 56 arranged in the drilling machine 20 is also visible.

Figure 2:
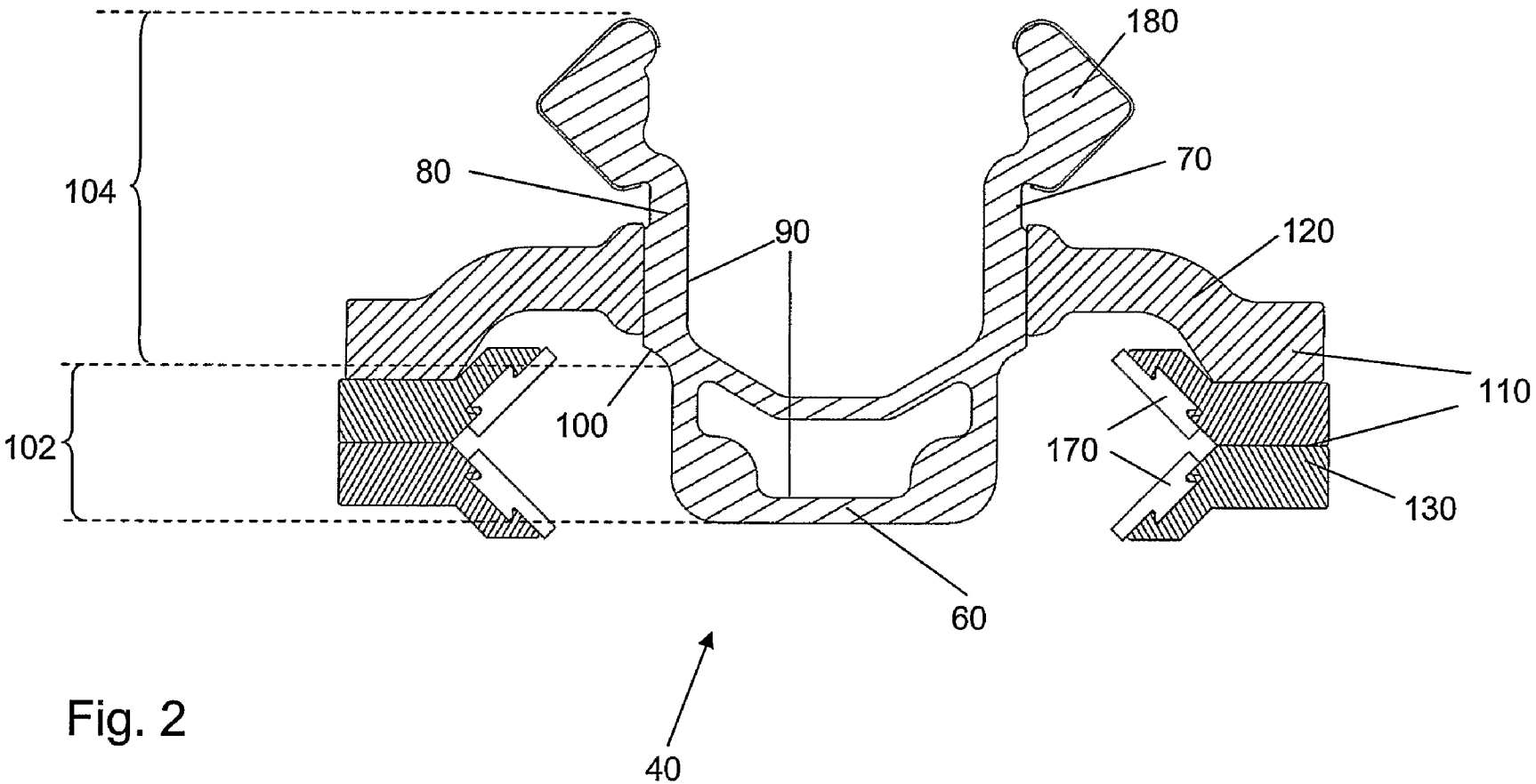
FIG. 2 is a schematic view of the cross section of an upper beam according to the present invention.

FIG. 2 illustrates a cross section of the upper beam 40. The upper beam 40 extends along a longitudinal axis and may for example be constituted by an extruded aluminium profile. The upper beam 40 comprises a bottom wan 60, a first side wall 70 and a second side wall 80 which results in a U-shaped cross section of the upper beam 40, wherein "upwards" of the upper beam 40 is defined as a direction towards the opening of the U-shape and wherein "downwards" of the upper beam 40 is defined as a direction towards the bottom wall 60. The upper beam 40, i.e. both the bottom wall 60 and the first 70 and second 80 side wall has an inward surface 90, which thus is constituted by the inside of the U-shaped upper beam 40 and an outwards surface 100 which thus is constituted by the outside of the U-shaped upper beam 40. The upper beam 40 has a height defined by the height of the side walls 60, 70 and a width defined by the distance between the first side wall 60 and the second side wall 70. The upper beam is vertically divided into a lower portion 102 which is the portion comprised by the bottom wall 60 and a lower portion of the side walls 70, 80 and an upper portion 104 which is the portion comprised by the upper portion of the side walls 70, 80. In order to reduce the height of the telescopic feeder 30, at least the lower portion 102 of the upper beam 40 is less wide that the lower beam 50 so that the lower portion 102 of the upper beam 40 may fit into the lower beam 50 and may thus fully or partly travel in the lower beam 50. The lower portion 102 is the portion of the upper beam 40 intended to travel in the lower beam 50 and the upper portion 104 is the portion of the upper beam 40 intended to protrude above the lower beam 50. In one embodiment, illustrated in FIG. 2, the lower portion 102 of the upper beam 40 is less wide than the upper portion 104 of the upper beam 40. The lower portion 102 of the upper beam 40 is also less wide than the lower beam 50. According to an alternative embodiment of the invention, the upper portion 104 and the lower portion 102 of the upper beam 40 may have the same width, i.e. the same width along its entire height, which width in this case thus is less than the width of the lower beam 50. The larger the vertical portion of the upper beam 40 travelling in the lower beam 50, the more compact the telescope feeder 30 may be, i.e. the lower the telescope feeder 30. A more compact telescope feeder 30 is advantageous since the centre of gravity is lower and the leverage of the telescopic feeder 30 decreases if it used for drilling in a position wherein it has been rotated somewhat around its longitudinal axis.

The upper beam 40 comprises cooperating members 110 intended for slidable cooperation with the lower beam 50 so that the upper beam 40 is telescopically displaceably arranged in the lower beam 50. The upper beam 40 moves along the longitudinal axis of the lower beam 50 in a conventional manner, e.g. utilizing a telescopic cylinder which may for example be fixedly mounted to the upper beam 40 and the lower beam 50, in a space between the upper beam 40 and the lower beam 50.

The upper beam 40 may comprise two or more cooperating means 110, arranged at the upper beam 40, advantageously on each of the outer surfaces 110 of the side walls 70, 80, alternatively on the bottom wall 60. The cooperating members 110 each comprise an attachment means 120 and a crank block bracket 130. The attachment means 120 is fixedly mounted on the upper beam 40 and fixedly mounted on the crank block bracket 130. The attachment means is arranged at the outward surface 100 of the upper beam 40, e.g. by means of welding, and is arranged so as to extend outwardly from the outer surface 100 of the side walls 70, 80. In order to enable the upper beam 40 to travel in the lower beam 50, and in order for the attachment means 120 to not be in the way for the lower beam 50, the attachment means 120 is vertically arranged at a portion of the side wall intended to protrude above the upper beam 50, i.e. is arranged at the upper portion 104 of the upper beam 40. This means that the attachment means 120 is arranged at a distance from the bottom wall 60 so that the lower portion 102 of the upper beam is free from protruding parts and enable the lower portion 102 to travel in the lower beam 50. In an alternative embodiment, the attachment means 120 is arranged on the bottom wall 60, in order for it not to be in the way for the lower beam 50 the attachment means 120 is arranged so as to run tightly along the bottom wall 60 and side walls 70, 80 of the upper beam 40 up to the upper portion 104, where it deflects outwardly from the outward surface 100 of the side walls 70, 80 as mentioned above.

The higher on the upper beam 40 the attachment means 120 extends outwards from the outward surface 100 of the side walls 70, 80, the larger the portion of the upper beam 40 that is enabled to travel in the lower beam 50. The attachment means 120 may be manufactured by extrusion or in another suitable manner and may be constituted by e.g. aluminium or other suitable material. The upper beam 40 has a front end 140 and a rear end 150 (see FIG. 1) which front end 140 is defined as the end which, when drilling, is facing the object to be drilled, e.g. rock, and the rear end 150 is defined as the end which is directed away from the object to be drilled. The cooperating members 110 are each arranged along a small portion of the longitudinal axis of the upper beam 40 in order to keep the weight low, preferably along 1/20-1/10 of the upper beam 40. The cooperating means 110 may for example be arranged in pairs on both the side wails 70, 80 in two respective separate positions along the upper beam 40 with an appropriate distance therebetween, preferably a distance which is sine third of the total length of the upper beam 40. This is in order to provide stability and allow a suitable extension of the telescopic feeder, this is illustrated in FIG. 1. For example, a pair of attachment means 120 may be arranged at the front end 140 of the upper beam 40 and another pair of attachment means 120 may be arranged at a distance of a third of the total length of the upper beam 40 from its front end 140. The attachment means 120 is intended for a fixed mounting of a crank block bracket 130, for example by means of a screw. The crank block bracket 130 is this fixedly mounted to the upper beam 40 by the attachment means 120 and slidably arranged against the lower beam 50.

Figure 4:
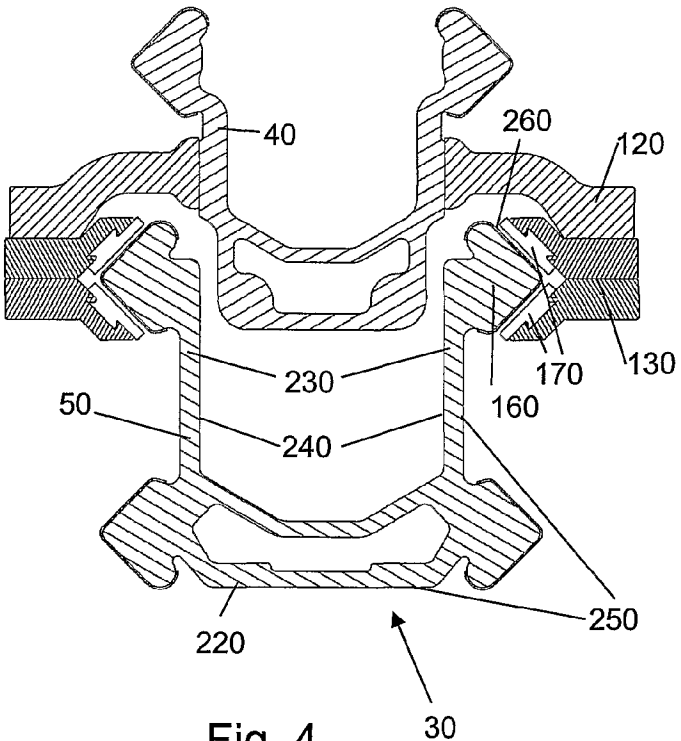
FIG. 4 is a schematic view of the cross section of a telescopic feeder according to the present invention.
Figure 3:
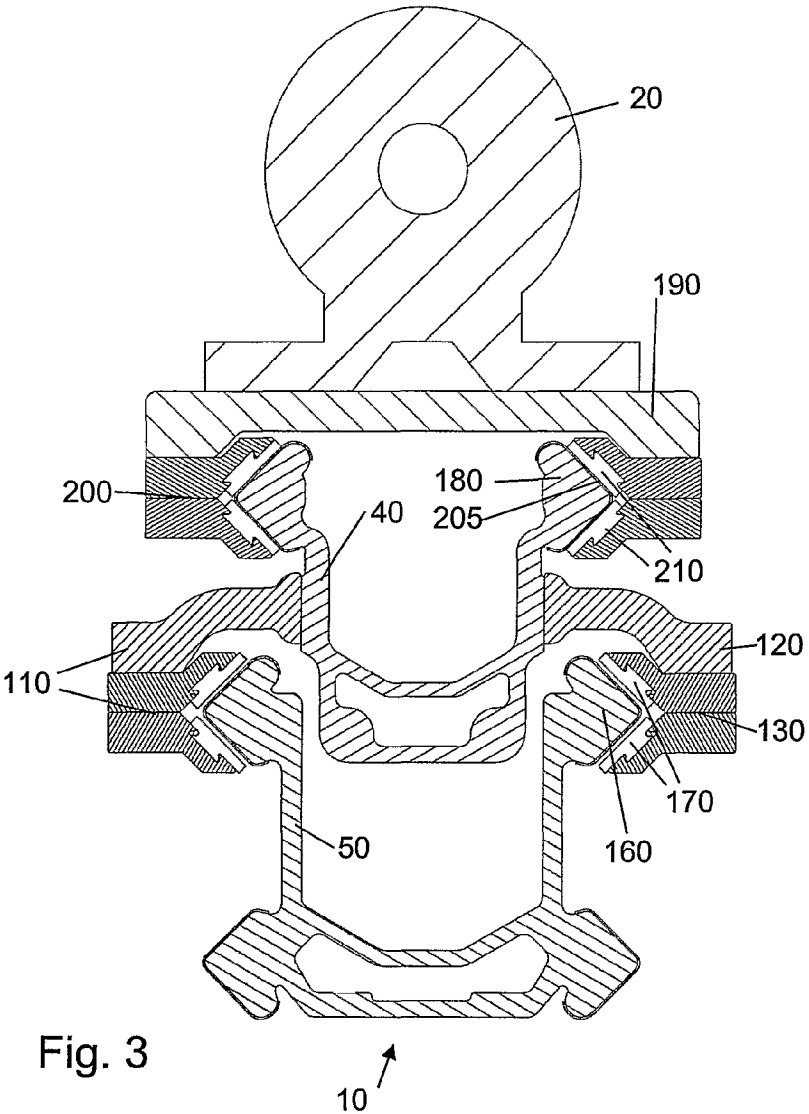
FIG. 3 is a schematic view of the cross section of a drilling device according to the present invention.

In FIG. 3, a cross section of the drilling device 10 is illustrated as well as how the upper beam 40 cooperates with a drilling machine 20 and with the lower beam 50. The crank block bracket 130 is intended for sliding cooperation with a slide rail 160 on the lower beam 50, which is illustrated in FIGS. 3 and 4. The crank block bracket 130 has a female profile suitable for sliding cooperation with the sliding rail 160 having a male profile, in the example in FIGS. 2, 3 and 4 the crank block bracket has a V-shaped profile for sliding cooperation with a V-shaped sliding rail 160. The crank block bracket 130 comprises one or a pair of sliding surfaces 170 arranged at the inside of the female profile, which sliding surfaces are intended to be in sliding contact with the sliding rail 160. The sliding surfaces 170 are made of a material with suitable sliding properties such as polyurethane or polyethylene. The crank block bracket 130 faces the outward surface 100 of each side wall 70, 80 of the upper beam 40, which means that also the sliding surfaces 170 also face the outward surface 100 of each side wall 70, 80 of the upper beam 40. The feature of the crank block bracket 130 facing the upper beam 40 and not an area below the bottom wall 60 of the upper beam 40 results in that there is a space between the crank block bracket 130 and the side walls 70, 80 of the upper beam 40 which space enables the upper beam 40 to partly travel in the lower beam 50. This also enables a stable and secure sliding motion between the upper beam 40 and the lower beam 50 without a risk of derailment. It is desired to have as low a weight as possible of the upper beam 40 in order to avoid leverage when drilling in a position wherein it has been rotated around its longitudinal axis. It is therefore an advantage to arrange the crank block brackets 130 and the attachment means 120 at the upper beam 40 and arrange the sliding rail 160 cooperating with the crank block bracket 130, on the lower beam 50 since the crank block bracket 130 and the attachment means 120 extend only along a small portion of the upper beam and thus have a lower weight than the sliding rail 160 extending along the entire lower beam 50.

The upper beam 40 also comprises a pair of sliding rails 180 intended for sliding cooperation with a carriage 190 on which carriage 190 the drilling machine 20 is arranged (the carriage is also illustrated in FIG. 1). The sliding rails 180 are arranged at the upper portion 104 of the upper beam 40 and extend along the longitudinal axis of the upper beam 40. The sliding rails 180 may for example be fixedly attached along the upper beam 40 or constitute a portion of its extruded profile. The sliding rails 180 have a suitable male profile for sliding cooperation with a crank block bracket 200 having a female profile. The sliding rails 180 may for instance be cladded with an outer layer 205 having suitable abrasion and sliding properties such as a thin steel sheet. The crank block bracket 200 is arranged on the carriage 190, which crank block bracket 200 comprises one or more sliding surfaces 210 arranged on the inside of the female profile, which sliding surfaces 210 are intended to be in sliding contact with the sliding rails 180. The sliding surfaces 210 are made of a material with suitable sliding properties such as e.g. polyurethane or polyethylene. In the example illustrated in FIG. 3, the sliding rails 180 and the crank block bracket 200 have V-shaped profiles.

FIG. 4 illustrates a cross section of the telescopic feeder 30 according to the present invention. The lower beam 50 extends along a longitudinal axis and may for example be constituted by a extruded aluminium profile. The lower beam 50 comprises a bottom wall 220 and side walls 230, which results in a U-shaped cross section of the lower beam 50, wherein upwards of the lower beam 50 is defined as a direction towards the opening of the U-shape and wherein "downwards" of the lower beam is defined as a direction towards the bottom wall 220. The lower beam 50, having an inward surface 240 which is constituted by the inside of the U-shaped lower beam 50 and an outward surface 250 which is constituted by the outside of the U-shaped lower beam 50. The lower beam 50 has a height being defined by the height of the side walls 230 and a width being defined by the distance between the side walls 230.

In order to reduce the height of the telescopic feeder 30, the lower beam 50 is wider than the total or at least the lower portion 102 of the upper beam 40 so that the lower beam 50 within its U-shape accommodates all of the lower portion 102 of the upper beam 40 in such a manner that the upper beam 40 fully or partially may travel in the lower beam 50. As mentioned above, it is a matter of fact that the larger the vertical portion of the upper beam 40 traveling in the lower beam 50, the more compact the telescopic feeder 30 can be made, i.e. the less is the height of the telescopic feeder. The lower beam 50 is manufactured of a suitable material such as e.g. an extruded aluminium profile. The lower beam 50 comprises a pair of slide rails 160 as mentioned above, intended for sliding cooperation with the above mentioned crank block bracket 130 arranged on the upper beam 40. The sliding rails 160 may for instance be cladded with an outer layer 260 having suitable abrasion and sliding properties such a thin steel sheet. The sliding rails 160 may be fixedly arranged along the lower beam 50 or constitute a part of its extruded cross section. Suitably, the slide rails 160 are arranged with one sliding rail on the outward surface 250 of each side wall 230. The slide rails 160 have a suitable male profile for cooperation with the female profile of the crank block bracket 130 on the upper beam 40. In the example in FIG. 4, the sliding rails 160 and the crank block bracket 130 are V-shaped profiles, as mentioned above. The slide rails 160 are advantageously arranged high up, preferably at the uppermost portion of the side wall 230, on the outer surface 250 of the lower beam 50 in order for cooperating members 110 of the upper beam 40 to be located as close as possible in order to engage with the sliding rails 160 of the lower beam 50.

The invention claimed is:

1. Upper beam intended to be used with a lower beam in a telescopic feeder for a drilling machine in rock drilling, said upper beam extending along a longitudinal axis and having a substantially U-shaped cross section comprising a bottom wall and a first and a second side wall, each side wall having an inward surface and an outward surface, and said upper beam comprises a cooperating member for sliding cooperation with the lower beam wherein said cooperating member comprises an attachment means extending outwardly from each outward surface of each side wall and that each attachment means is mounted to a crank block bracket which faces said outward surface of each side wall.

2. Upper beam according to claim 1, wherein the crank block bracket comprises a sliding surface, which sliding surface faces said outward surface of each side wall.

3. Upper beam according to claim 2, wherein said sliding surface is constituted by polyurethane or polyethylene.

4. Upper beam according to claim 1, wherein the cooperating member is arranged along a small part of the upper beam, preferably along one twentieth of the upper beam.

5. Upper beam according to claim 1, wherein the cooperating member is arranged at both side walls in respectively two different positions along the upper beam.

6. Upper beam according to claim 1, wherein the upper beam comprises a lower portion and an upper portion, which lower portion is intended to travel inside the lower beam and which upper portion is intended to protrude above the lower beam during sliding cooperation with the lower beam, and wherein the attachment means is arranged on the upper portion.

7. Upper beam according to claim 1, wherein the upper beam is constituted by an extruded aluminum profile.

8. Upper beam according to claim 1, wherein the attachment means is constituted by an extruded aluminum profile.

9. Upper beam according to claim 1, wherein the crank block bracket is fixedly mounted on the attachment means by a screw.

10. Upper beam according to claim 1, wherein the upper beam comprises a pair of slide rails intended for slidable cooperation with the drilling machine for rock drilling.

11. Upper beam according to claim 1, wherein the upper beam is constituted by an extruded aluminum profile, and the slide rails are a part of the extruded aluminum profile of the upper beam.

12. Telescopic feeder for a drilling machine for rock drilling, comprising a substantially U-shaped lower beam wherein the telescopic feeder comprises an upper beam extending along a longitudinal axis and having a substantially U-shaped cross section comprising a bottom wall and a first and a second side wall, each side wall having an inward surface and an outward surface, and said upper beam comprises a cooperating member for sliding cooperation with the lower beam, wherein said cooperating member comprises an attachment means extending outwardly from each outward surface of each side wall and that each attachment means is mounted to a crank block bracket which faces said outward surface of each side wall.

13. Telescopic feeder according to claim 12, wherein the lower portion of the upper beam is less wide than the lower beam so that the lower portion of the upper beam will fit into the lower beam.

14. Telescopic feeder according to claim 12, wherein the lower beam comprises slide rails intended for sliding cooperation with the cooperating member of the upper beam.

15. Telescopic feeder according to claim 14, wherein the slide rails extend along the entire lower beam.

16. Telescopic feeder according to claim 14, wherein the slide rails are arranged at an upper portion of the respective side walls of the lower beam.

17. Telescopic feeder according to claim 12, wherein the lower beam comprising the slide rails is constituted by an extruded aluminum profile.

18. Telescopic feeder according to claim 12, wherein the weight per unit length of the lower beam is greater than the weight per unit length of the upper beam.

19. Drilling device for rock drilling, comprising a drilling machine, wherein the drilling device comprises a telescopic feeder comprising a substantially U-shaped lower beam, an upper beam intended to be used with the lower beam, said upper beam extending along a longitudinal axis and having a substantially U-shaped cross section comprising a bottom wall and a first and a second side wall, each side wall having an inward surface and an outward surface, and said upper beam comprises a cooperating member for sliding cooperation with the lower beam, wherein said cooperating member comprises an attachment means extending outwardly from each outward surface of each side wall and that each attachment means is mounted to a crank block bracket which faces said outward surface of each side wall.

20. Drilling device according to claim 19, wherein the drilling machine is slidably arranged on the upper beam.

21. Drilling device according to claim 20, wherein the drilling machine is fixedly attached on a carriage, which carriage comprises a crank block bracket for slidable cooperation with the upper beam.

22. Drilling device according to claim 21, wherein said crank block bracket comprises one or more sliding surfaces, which sliding surfaces are intended for slidable cooperation with the slide rail of the upper beam.

* * * * *